US006667255B2

(12) United States Patent
Hexels

(10) Patent No.: US 6,667,255 B2
(45) Date of Patent: Dec. 23, 2003

(54) GARMENT, IN PARTICULAR UNDERGARMENT, FOR PERSONS IN MILITARY AND CIVIL DEFENSE SERVICES

(75) Inventor: Gerd Hexels, Nettetal (DE)

(73) Assignee: Texplorer GmbH (DE)

( * ) Notice: Subject to any disclaimer, the term of this patent is extended or adjusted under 35 U.S.C. 154(b) by 296 days.

(21) Appl. No.: 09/737,529

(22) Filed: Dec. 13, 2000

(65) Prior Publication Data

US 2001/0004575 A1 Jun. 21, 2001

(30) Foreign Application Priority Data

Dec. 15, 1999 (DE) ..... 299 22 034 U

(51) Int. Cl.[7] ..... B32B 5/26; B32B 5/30; B32B 5/16; B27N 9/00; A62B 17/00

(52) U.S. Cl. ..... 442/393; 442/381; 442/417; 442/121; 442/122; 428/920; 428/921; 428/244; 2/455

(58) Field of Search ..... 442/381, 393, 442/417, 121, 122; 428/244, 920, 921

(56) References Cited

U.S. PATENT DOCUMENTS

RE29,630 E * 5/1978 May ..... 427/393.3
6,309,897 B1 * 10/2001 Livengood ..... 438/14

* cited by examiner

*Primary Examiner*—Ula Ruddock
*Assistant Examiner*—Jennifer Boyd
(74) *Attorney, Agent, or Firm*—Wells St. John P.S.

(57) ABSTRACT

A garment, in particular an undergarment, for persons in military and civil defense services is provided with a first nonwoven (1) of natural fibers or synthetic fibers, a second nonwoven (5) of natural or synthetic fibers and discrete flakes (4) of expanded graphite as a flame-retardant material, which are applied to at least one of the surfaces of the two nonwovens (1, 5).

9 Claims, 1 Drawing Sheet

GARMENT, IN PARTICULAR UNDERGARMENT, FOR PERSONS IN MILITARY AND CIVIL DEFENSE SERVICES

FIELD OF THE INVENTION

The invention relates to a garment, in particular an undergarment, for persons in military and civil defense services.

BACKGROUND

Garments, in particular undergarments, which serve as protection against the cold, have as an essential component a polymer nonwoven, usually a polyester nonwoven. Very good insulation against effects of the weather is achieved with this material, in particular as protection against the cold. However, the disadvantage of the known garments is that they are highly flammable. This means that in military and civil defense services especially, where persons often work or are situated in the vicinity of open flames, such as for example fire department personnel attending a fire or soldiers and civil defense units at an open fire or camping by an open fire, there is a not inconsiderable risk to the persons provided with such easily combustible garments.

The present invention is therefore based on the object of providing a garment, in particular an undergarment, for persons in military and civil defense services which is not as easily combustible, while the good insulating properties are to be retained and, if need be, high wearing comfort is also provided.

This object is achieved according to the invention by the combination of features stated as, for example: a garment, in particular an undergarment, for persons in military and civil defense services, with a first nonwoven of natural fibers or synthetic fibers, a second nonwoven of natural or synthetic fibers and discrete flakes of expanded graphite as a flame-retardant material, which are applied to at least one of the surfaces of the two nonwovens.

It has been found in practice that the combination according to the invention of the two nonwovens with the discrete flakes of expanded graphite creates a significantly improved flame-retardant garment, even though very good insulating properties can be achieved by the two nonwovens—depending on the materials selected for them.

The use of expanded graphite as a flame-retardant material is known in principle from the construction sector as an insulating material, in the home textiles sector as carpeting and in the automobile and filter sector, but in these cases sheet-like formations were always provided as a backing material.

However, it has been found in a surprising way that, discrete flakes of expanded graphite are likewise suitable in clothing as well for providing a garment with greater resistance to catching fire, while at the same time the main property of the garment, that is protection against effects of the weather, in particular protection against the cold, is not impaired.

Polyester fibers may be used as a possible advantageous material for the first nonwoven, which is arranged for example on the outside. For the second nonwoven, which may form an inner nonwoven on the side facing the wearer, polyester may likewise be provided, or else polyamide.

A further significant increase in the wearing comfort is obtained if, in a very advantageous refinement of the invention, it is provided that a membrane permeable to water vapor and air is arranged between one of the two nonwovens and the flakes of expanded graphite.

It has been found that, in spite of the flakes of expanded graphite, breathability of the garment can be achieved if a membrane permeable to water vapor and air is arranged in the way specified. In this case, the connection to the neighboring materials is carried out—at least on one side—in an advantageous way as adhesive spot bonding, in order that good breathability or water-vapor and air permeability via the pores of the membrane is retained.

The flakes of expanded graphite can be applied to a nonwoven in various ways. In an advantageous refinement, the flakes are distributed in a layer of hot-melt adhesive, which before the heat treatment is in the form of granules. The hot-melt adhesive is then sprinkled onto one of the two nonwovens, for example the second nonwoven, after which the entire item runs over a temperature-controlled section in a calender and is bonded together, i.e. laminated, under heat and pressure.

If designed as a three-layer laminate with a first nonwoven, the intermediate flakes of expanded graphite, which have been taken up in the layer of hot-melt adhesive, and the second nonwoven, the temperature control, and consequently the bonding to form the three-layer laminate, can be carried out in one operation.

If, to increase wearing comfort, a membrane is to be included in the laminated structure, this can take place in a very advantageous development of the invention by the second nonwoven being bonded to the membrane via the layer of hot-melt adhesive with the expanded graphite, while the membrane is bonded to the first nonwoven via spots of adhesive.

BRIEF DESCRIPTION OF DRAWING

An exemplary embodiment of the invention is described in principle below with reference to the drawing, FIG. 1, the single FIGURE representing a detail of part of a garment in cross section, on a greatly enlarged scale for reasons of clarity. The garment may be an undergarment, such as for example an undershirt, shorts or socks.

DETAILED DESCRIPTION

Figure 1:
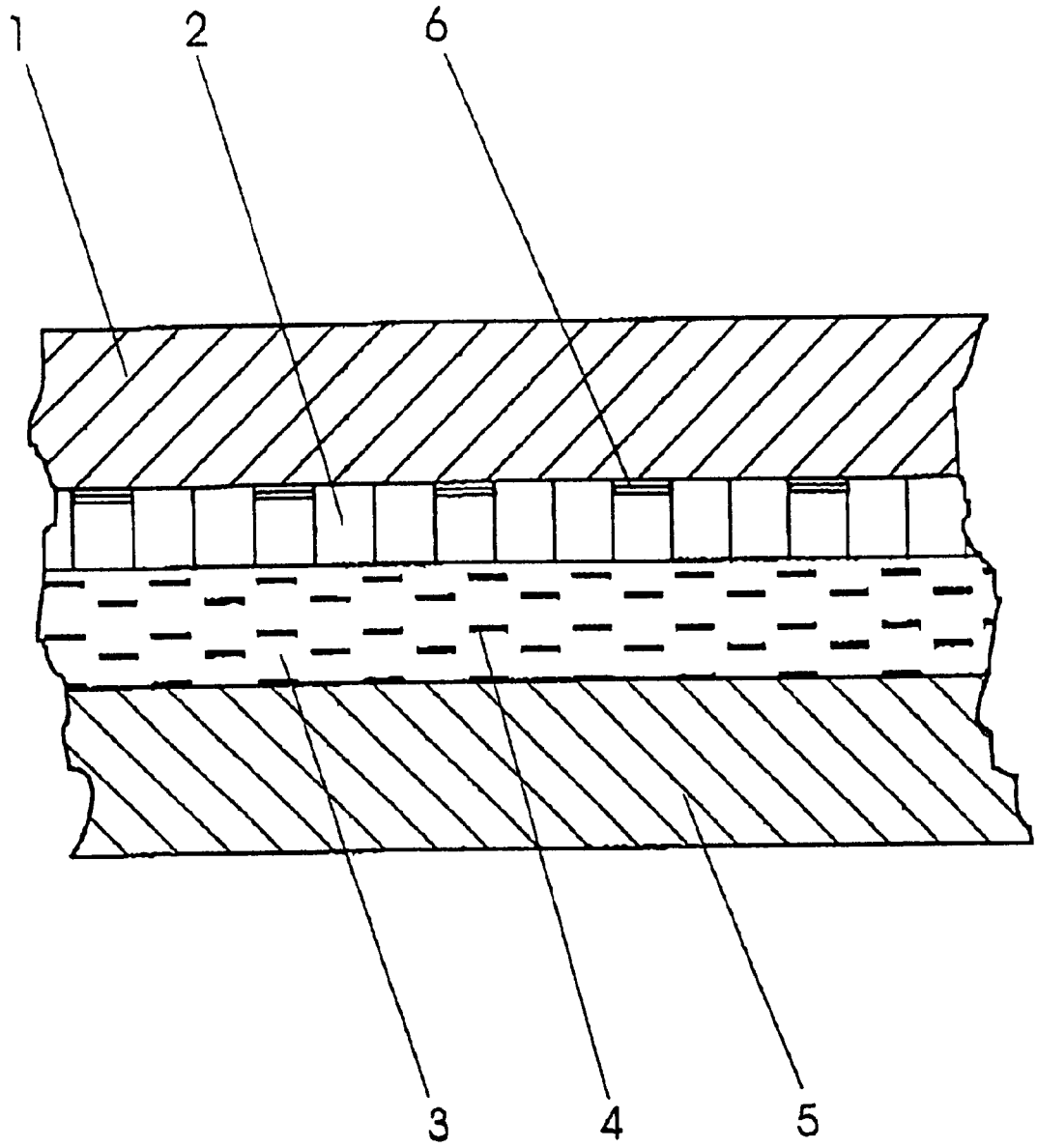

The garment comprises a first nonwoven 1 of polyester fibers, a membrane 2 lying thereunder, a layer of hot-melt adhesive 3, into which a multiplicity of discrete or individual flakes 4 of expanded graphite have been placed, and a second nonwoven 5, which lies on the side of the layer of hot-melt adhesive 3 facing away from the membrane 2.

The first nonwoven 1 is generally roughened and lies on the outside (however, it may also be produced flat and lie on the inside), while the second nonwoven 5 (possibly also roughened) is facing the wearer of the garment. It goes without saying that this structure is given only as an example. For reasons of comfort, materials which are known by the trade names Goretex and Sympatex may be used as the membrane 2. It goes without saying, however, that other membranes which ensure corresponding breathability are also possible within the scope of the invention.

If the garment is provided without a membrane 2, its production can take place in a simple way by the coating of hot-melt adhesive being sprinkled in solid form, for example in the form of powder or granules, onto one of the two nonwovens 1 or 5, the other nonwoven placed thereover and the unit bonded together under heat and pressure to form a three-layer structure.

If a garment is to be produced in the form represented, this may take place for example by the membrane 2 being bonded to the first nonwoven 1 via spots of adhesive 6 and a two-layer laminate produced in this way.

The expanded graphite 4 with the hot-melt adhesive in powder form is then sprinkled onto the second nonwoven 5, likewise thermally treated, with the hot-melt adhesive becoming active for forming a layer of hot-melt adhesive 3, and consequently, after a preceding placement of the previously formed two-layer laminate comprising the nonwoven 1 and the membrane 2 over the layer of hot-melt adhesive 3, all the materials are bonded together to form a unit.

Instead of applying the flakes 4 of expanded graphite by means of a hot-melt adhesive in powder form, it goes without saying that the flakes 4 can also be bonded with the associated nonwoven in some other way. For example, the surface of the nonwoven 1 or 5 may be sprayed with an aqueous polymer solution, it being possible for the sprinkling on of the flakes 4 of expanded graphite to take place before or after the spraying.

Similarly, it is possible to apply the flakes 4 of expanded graphite to the surface of the nonwoven 1 or 5 in the form of a suspension or dispersion together in aqueous polymer solutions. The diameters or sizes of the flakes may be, for example, between 0.1 mm and several mm.

What is claimed is:

1. A garment, in particular an undergarment, for persons in military and civil defense services, comprising a first nonwoven of natural fibers or synthetic fibers, a second nonwoven of natural or synthetic fibers and discrete flakes of expanded graphite as a flame-retardant material, which are applied with an adhesive to at least one of the surfaces of the two nonwovens, and wherein a membrane permeable to water vapor and air is arranged between one of the two nonwovens and the flakes of expanded graphite.

2. The garment as claimed in claim 1, wherein polyester fibers are provided as the first nonwoven.

3. The garment as claimed in claim 1, wherein the second nonwoven consists of polyester.

4. The garment as claimed in claim 1, wherein the second nonwoven consists of polyamide.

5. The garment as claimed in claim 1, wherein the flakes of expanded graphite are distributed in a layer of hot-melt adhesive.

6. The garment as claimed in claim 5, wherein the two nonwovens and the flakes of expanded graphite are bonded together by the layer of hot-melt adhesive to form a four-layer laminate.

7. The garment as claimed in claim 5, further comprising a membrane and wherein the second nonwoven is bonded to the membrane by means of the layer of hot-melt adhesive with the expanded graphite, while the membrane is bonded to the first nonwoven by means of spots of adhesive.

8. A flame retardant garment component, comprising:

a first nonwoven;

a second nonwoven;

discrete flakes of expanded graphite as a flame-retardant material, applied to at least one of the nonwovens;

wherein the flakes of expanded graphite are distributed in a layer of hot-melt adhesive between the first and second nonwovens.

9. The garment as claimed in claim 8, further comprising a membrane and wherein the second nonwoven is bonded to the membrane by moans of the layer of hot-melt adhesive with the expanded graphite, and wherein the membrane is bonded to the first nonwoven by means of spots of adhesive.

* * * * *

UNITED STATES PATENT AND TRADEMARK OFFICE

CERTIFICATE OF CORRECTION

PATENT NO. : 6,667,255 B2
APPLICATION NO. : 09/737529
DATED : December 23, 2003
INVENTOR(S) : Gerd Hexels It is certified that error appears in the above-identified patent and that said Letters Patent is hereby corrected as shown below:

On the Title Page Item (56) References Cited -
U.S. PATENT DOCUMENTS – Please insert:

--6,309,987 B1 * 10/2001 Srinivasan ..... 442/147--

Col 1 lines 3-5 – Please insert before FIELD OF THE INVENTION –

--CROSS REFERENCE TO RELATED APPLICATION
This application relates to and claims priority to corresponding German Patent Application No. 299 22 034.6, which was filed on December 15, 1999, and which is incorporated by reference herein.--

Col. 1, line 53 – Please insert:

--when in appropriate combination with the two nonwovens,--

Signed and Sealed this

Seventeenth Day of June, 2008

JON W. DUDAS
*Director of the United States Patent and Trademark Office*